US006120361A

United States Patent [19]

Konishi et al.

[11] Patent Number: 6,120,361

[45] Date of Patent: Sep. 19, 2000

[54] POLISHING APPARATUS, POLISHING MEMBER

[75] Inventors: Nobuo Konishi, Yamanashi-ken; Mitsuaki Iwashita, Nirasaki, both of Japan

[73] Assignee: Tokyo Electron Limited, Tokyo, Japan

[21] Appl. No.: 09/017,368

[22] Filed: Feb. 2, 1998

[30] Foreign Application Priority Data

Feb. 3, 1997 [JP] Japan ..... 9-035482

[51] Int. Cl.[7] ..... B24B 29/00

[52] U.S. Cl. ..... 451/287; 451/288; 451/290; 451/527; 451/550

[58] Field of Search ..... 451/286, 287, 451/288, 289, 290, 527, 548, 550

[56] References Cited

U.S. PATENT DOCUMENTS

| | | | |
|---|---|---|---|
| 2,242,877 | 5/1991 | Albertson . | |
| 2,347,244 | 4/1944 | Colt et al. . | |
| 2,755,607 | 7/1956 | Haywood . | |
| 3,869,263 | 3/1975 | Greenspan . | |
| 4,037,367 | 7/1977 | Kruse . | |
| 4,055,029 | 10/1977 | Kalbow . | |
| 4,821,461 | 4/1989 | Holmstrand . | |
| 5,190,568 | 3/1993 | Tselesin . | |
| 5,199,227 | 4/1993 | Ohishi . | |
| 5,278,308 | 3/1998 | Muroyama | 216/88 |
| 5,618,227 | 4/1997 | Tsutsumi et al. | 451/288 |
| 5,681,217 | 10/1997 | Hoopman et al. | 451/528 |
| 5,722,875 | 5/1998 | Iwashita et al. | 451/8 |
| 5,733,178 | 3/1998 | Ohishi . | |
| 5,759,087 | 6/1998 | Masumura et al. | 451/41 |
| 5,801,066 | 9/1998 | Meikle | 438/14 |
| 5,827,395 | 10/1998 | Masumura et al. | 156/345 |
| 5,895,550 | 4/1999 | Andreas | 156/345 |

FOREIGN PATENT DOCUMENTS

| | | |
|---|---|---|
| 3-175694 | of 0000 | Japan . |
| 7-233166 | of 0000 | Japan . |
| 7-290367 | of 0000 | Japan . |
| 9-132661 | of 0000 | Japan . |
| 9-132666 | of 0000 | Japan . |

*Primary Examiner*—Timothy V. Eley
*Attorney, Agent, or Firm*—Morrison & Foerster

[57] ABSTRACT

A polishing apparatus includes a polishing layer formed of forming resin and having a plurality of mechanical polishing particles contained in the polishing layer so as to be partially exposed from a polishing surface thereof. An object to be polished and the polishing layer are rotated relative to each other so that the object is polished with the mechanical polishing particles, in a state in which the object is allowed to contact with the polishing surface of the polishing layer.

13 Claims, 3 Drawing Sheets

POLISHING APPARATUS, POLISHING MEMBER

BACKGROUND OF THE INVENTION

The present invention relates to a polishing apparatus, a polishing member and a method of polishing an object such as a semiconductor wafer by using polishing cloth or the like.

Of the processes for producing a semiconductor element on a semiconductor wafer (hereinafter called a "wafer"), there is known a polishing process called CMP (Chemical Mechanical Polishing). According to this CMP process, a polishing liquid including mechanical polishing particles, and a chemical polishing agent or liquid is dropped onto a surface of the polishing cloth, and the surface of the polishing cloth is directly pressed on an object such as a wafer or a layer (an insulation layer or conductive layer) formed on the wafer. Then, part of the surface of the object is removed by the polishing treatment.

For example, a process of polishing the insulation layer is applied to a planarization step called the etch-back in a process of forming a multilayer interconnection.

According to a conventional CMP process, for example, in a CMP apparatus shown in FIG. 6, a surface of a wafer 10 or a layer formed thereon, held by a wafer holding mechanism 13 is pressed at a predetermined pressure on a rotary table 12 having a surface attached with polishing cloth 11 as a polishing layer. The rotary table 12 is rotated and also the wafer holding mechanism 13 is rotated by a motor 15 in directions shown by arrows while supplying a polishing liquid from a nozzle 14 to the surface of the polishing cloth 11. Thus, the surface of the wafer 10 (or a layer formed on the wafer) is polished by rotating and relatively revolving the wafer 10 on the rotary table 12.

Foaming resin such as foam urethane resin being, for example, about 1.2 mm thick is used as the polishing cloth 11, and a slurry liquid obtained by dispersing silica ($SiO_2$) as mechanical polishing particles and the chemical polishing liquid is used as the polishing liquid. In this CMP process, mechanical polishing particles enter many recess portions formed by foaming on the upper surface of the foaming resin, and friction caused by the mechanical polishing particles captured in the recess portions, i.e. the mechanical polishing effect, can be thereby obtained. It is thought that the complex effect of both the mechanical polishing effect and the chemical polishing effect may be related greatly to the polishing mechanism.

In the above-described CMP process, for example, the polishing rate becomes lower every time one wafer 10 is polished. The reason can be understood as follows. When the wafer 10 is polished, shavings of the wafer 10 or layer formed thereon may enter the recess portions on the surface of the polishing cloth 11, as well as the mechanical polishing particles in the polishing liquid. When the polishing step proceeds and the shavings of the wafer 10 entering the recess portions are increased, the shavings may cause the mechanical polishing particles, which have entered the recess portions, to be taken out thereof.

Thus, as the polishing process proceeds, the mechanical polishing particles captured in the recess portions may be reduced, and proportionally to this, sliding between the polishing cloth 11 and the wafer 10 may become remarkable. Therefore, since a large friction force cannot be obtained, the polishing rate may become smaller.

At this time, since the shavings entering the recess portions on the surface of the polishing cloth 11 cannot be removed by a brush, etc., for example, the surface of the polishing cloth 11 is shaved by diamond, etc. to make a new surface of the polishing cloth every time one wafer 10 is treated. In order to execute this work, the polishing has to be interrupted. If this work is further executed, the foaming resin (polishing cloth 11) itself is also shaved, which causes the life cycle of the polishing cloth 11 to be shortened. For this reason, the polishing cloth 11 has to be replaced with a new one, for example, after processing five hundred wafers 10. Therefore, the troublesome exchange of the wafers has to be executed many times, and every exchange interrupts the CMP process. As a result, the throughput of the CMP process is lowered.

BRIEF SUMMARY OF THE INVENTION

The object of the present invention is to provide a polishing apparatus and a polishing method, which are improved and novel.

According to an aspect of the present invention, the present invention provides

A polishing apparatus comprising:

a polishing layer having a polishing surface on which a plurality of recess portions and protruding portions are formed, and a plurality of mechanical polishing particles contained in the polishing layer so as to be partially exposed from the polishing surface; and a drive mechanism for moving an object to be polished and the polishing layer relative to each other to polish the object with the mechanical polishing particles, in a state in which the object is allowed to contact with the polishing surface of the polishing layer.

According to another aspect, the present invention provides

A method of polishing an object to be polished, while sliding said object and a polishing layer relative to each other, wherein the polishing layer in which mechanical polishing particles having a mechanical polishing effect are used, and said object is polished while supplying a polishing liquid containing chemical polishing particles having a chemical polishing effect onto a polishing surface of the polishing layer having bumps.

The polishing layer is preferably formed of foaming resin.

The polishing liquid preferably does not preferably contain the mechanical polishing particles, but the chemical polishing agent only.

It is preferable that the polishing layer is formed of foaming resin and has a plurality of mechanical polishing particles dispersed in the resin.

The foaming resin preferably has a foam space having an average diameter of approximately 200 to 500 nm.

Preferably, the mechanical polishing particles are silica-based polishing particles having an average diameter of 30 to 100 nm, or alumina-based or ceria-based polishing particles having an average diameter of 50 to 300 nm.

Further, according to the other embodiment, the present invention provides a polishing member formed by dispersing mechanical polishing particles in a binder resin and foaming the binder resin.

Additional object and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 4A and 4B are views for explaining the effect of polishing cloth, in which FIG. 4A shows a conventional manner and FIG. 4B shows a manner of the present invention;

DETAILED DESCRIPTION OF THE INVENTION

An embodiment of a polishing apparatus and polishing method of the present invention will be described.

Figure 1:
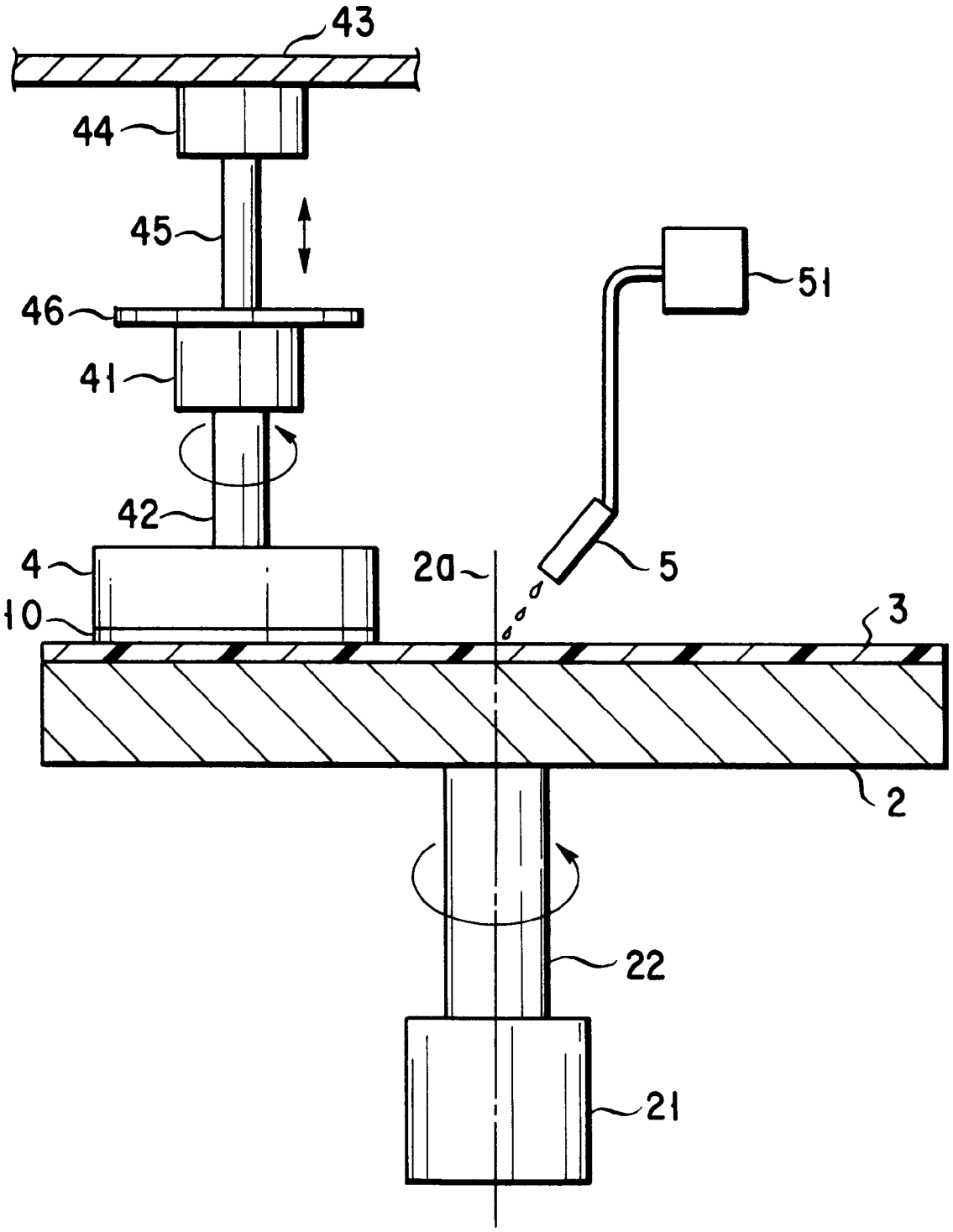
FIG. 1 is a view schematically showing a polishing apparatus according to an embodiment of the present invention.
Figure 2:
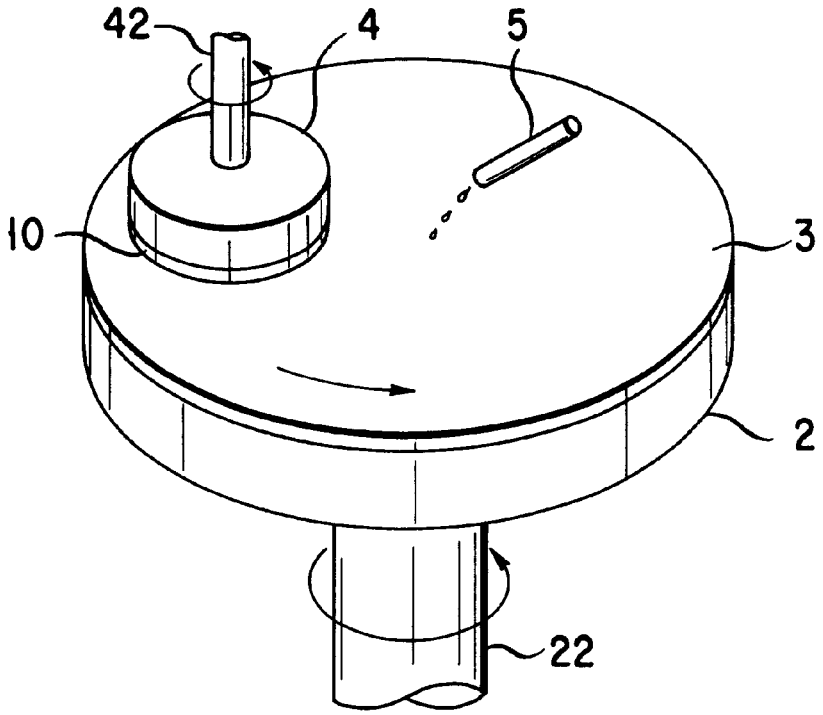
FIG. 2 is a perspective view showing a part of the polishing apparatus shown in FIG. 1.

First, the entire structure of the polishing apparatus of the present invention will be described with reference to FIGS. 1 and 2. The polishing apparatus comprises a motor 21, a perpendicularly extending rotary shaft 22, which has its lower portion connected to the motor and is rotated about a rotary axis 2*a* as shown by an arrow by the motor, and a disc-shaped rotary table 2, which has a center of its lower surface connected to the upper portion of the rotary shaft and is positioned horizontally. Polishing cloth serving as a circular polishing layer having almost the same area as that of the rotary table 2, or a polishing layer 3 is applied to an upper surface of the rotary table 2. A wafer supporting mechanism for holding a wafer 10 as a polished object and allowing it to contact with the polishing cloth 3 at a predetermined pressure at a position shifted from the center while rotating it, and a polishing liquid supply nozzle 5 for supplying a polishing liquid to a center of the surface of the polishing cloth 3, are provided above the rotary table 2.

The wafer supporting mechanism has a disc-shaped wafer holding member 4, which faces the polishing cloth 3. This holding member 4 comprises, for example, a vacuum chuck mechanism which adsorbs and holds the wafer 10 at a position displaced from the center of the rotary table 2 so as to allow a surface to be polished (which indicates not only a surface of the wafer, but also a surface of a layer formed on the surface of the wafer, for example, an insulation layer such as an $SiO_2$ film or a surface of an electrically conductive layer such as an Al film) to be set at a lower side and allows the polished surface to be in surface contact with part of the polishing cloth 3. A lower end portion of a rotary shaft 42, which is vertically elongated so as to be rotatable by a motor 41, is connected to the center of an upper surface of the holding member 4. As a result, the wafer 10 is horizontally rotated by the motor 41 as shown by an arrow via the rotary shaft 42 and the holding member 4. This motor 41 is attached to a lift member 46 connected to a lower end of a vertically elongated lift shaft 45. An upper end portion of the lift shaft 45 is connected to a lift mechanism 44 provided at a fixing plate 43. The lift mechanism is a well-known one, moving the lift shaft 45 vertically in a predetermined distance as shown by an arrow having double heads by a motor, etc. The polishing liquid supply nozzle 5 is constituted to supply a chemical polishing liquid (hereinafter called "chemical polishing agent") having a chemical polishing effect, for example, a polishing liquid containing a fluorine compound, from a polishing liquid supply source 51, to, for example, almost the center of rotation (in the rotary axis 2*a*) of the polishing cloth 3.

As for the chemical polishing agent, ferric nitrate (chiefly for tungsten), hydrogen peroxide, oxalic acid, etc. may be used when the polished surface is made of metal, and potassium hydroxide, potassium fluoride, ammonia, etc. may be used when it is made of $SiO_2$. In addition, ferric nitrate, etc. may be used as the chemical polishing agent when the polished surface is made of an organic member. The chemical polishing agent is not limited to the above ones, and various kinds of the chemical polishing agents, for example, chelate compound, etc. may be applied in accordance with the material of the polished surface, which is apparent to a person skilled in the art.

Figure 3:
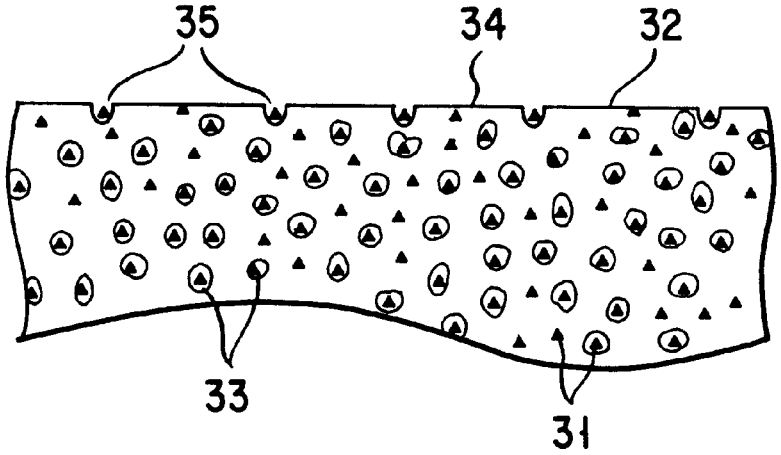
FIG. 3 is a cross-sectional view showing a part of polishing cloth used for the polishing apparatus of the present invention.

As partially shown in FIG. 3, the polishing cloth is formed by foaming resin layer 32 including many mechanical polishing particles 31 therein. This foaming resin layer 32 is formed by foam urethane resin being, for example, 1.2 mm thick, which has small spaces or holes 33 equal to an average diameter of, for example, approximately 200 to 2000 nm, and preferably, approximately 200 to 500 nm. Many mechanical polishing particles 31 are dispersed in the spaces 33 and the other portions of the foaming resin 32. As for the mechanical polishing particles, it is possible to use, for example, a silica-based polishing agent such as $SiO_2$ for the polishing of a silicon wafer and an $SiO_2$ film, an alumina-based polishing agent for the polishing of an $SiO_2$ film and a metal film, and a ceria-based polishing agent for the polishing of an $SiO_2$ film, a metal film and an optical glass. However, the mechanical polishing particles used in the present invention are not limited to these polishing agents, and various kinds of mechanical polishing particles that are well known in this technical field may be used. It is preferable that the silica-based mechanical polishing particles have an average particle diameter ranging from 30 to 100 nm and alumina-based or ceria-based mechanical polishing particles have an average particle diameter ranging from 50 to 300 nm. In this preferable embodiment, silica ($SiO_2$)-based mechanical polishing particles 31 having an average diameter of approximately 200 nm are dispersed in the foaming resin 32 and exposed to a polishing surface 34 (which is not the entirely upper surface of the polishing cloth 3, but the area of the upper surface contacting with the object). The mechanical polishing particles 31 exposed to the polishing surface 34 are partially in small recess portions or concaves 35, which are part of the spaces or holes 33 and partially in the polishing surface other than the recess portions 35. (In FIG. 3, black triangles represent the mechanical polishing particles. However, the shape of each polishing particle is not limited to a triangle, but may be polygon or the other shape such as a square.)

Such the polishing cloth 3 can be formed by, for example, dispersing the mechanical polishing particles in the binder resin and foaming this binder resin. According to this manner, the polishing cloth 3 is produced by, for example, adding approximately a few percent by weight to tens of percent by weight of $SiO_2$ particles having a particle diameter of approximately 30 nm to urethane resin which is the binder resin, stirring the urethane resin to disperse the of $SiO_2$ particles in the urethane resin, and heating the urethane resin so as to foam the urethane resin. At this time, the $SiO_2$ particles aggregate in the binder resin to have a particle diameter of approximately 200 nm. The urethane resin foams while incorporating the $SiO_2$ particles so that the $SiO_2$ particles enter the spaces generated by the foaming and the other areas. By processing the foaming object thus obtained in a predetermined shape, the polishing cloth 3 can be formed. In this case, the foaming density preferably ranges from 15 to 30%.

This is because, preferably, the foaming density of the foaming resin should be small so that bumps on the polished surface of the object can be effectively planarized by reducing portions of the polishing cloth contacting with the object which are deformed in accordance with the bumps, and be large so that the polishing rate can be made higher by increasing the recess portions and the polishing particles captured by the recess portions.

In the above-described polishing apparatus, the wafer (or the layer formed thereon) is polished in the following steps. First, the wafer 10 is adsorbed in vacuum by the holding member 4 raised at the uppermost position by the lift mechanism 44 while setting the polished surface of the object (the surface of the wafer or the layer formed on the wafer) to face downward. Then, as the wafer holding member 4 and the rotary table 2 are rotated by the motors 41 and 21, respectively, the wafer holding member 4 is lowered so as to make the polished surface of the wafer 10 contact with the polishing cloth 3 at a predetermined pressure, and the polishing liquid including the chemical polishing agent is dropped from the supply nozzle 5 onto the center of the surface of the polishing cloth 3 (or the center of the rotary table 2). The polishing liquid supplied onto the center of the polishing cloth 3 flows to the periphery of the polishing cloth 3 by a centrifugal force caused by the rotation of the rotary table 2 and then enters between the polishing cloth 3 and the polished surface of the object. At this time, for example, if the polishing agent has a smooth surface, the polishing liquid may hardly enter between the polishing cloth 3 and the polished surface. In this embodiment, however, since the polishing cloth is formed of a foaming object, the surface entirely has bumps or projections, i.e. the surface is not smooth. For this reason, the polishing liquid can easily enter between the polishing cloth 3 and the polished surface through the clearances formed by the bumps, little polishing liquid is wasted, and the polishing time is short. Further, since bumps are formed over the entire polishing surface, even if the object is in close contact with the polishing surface, the polishing liquid can easily enter uniformly between the polishing surface and the object, and therefore, the polishing cannot be executed with irregularity.

According to the above manner, the polished surface of the object is polished while the wafer 10 rotates itself and revolves relatively to the rotary table 2. This polishing mechanism is not confirmed, but it is thought that the polishing process may proceed according to the multiplier effect achieved from both the mechanical polishing effect, which is friction between the polished surface of the object and the mechanical polishing particles 31, and the chemical polishing effect, which is a chemical reaction occurring by the polished surface and the chemical polishing particles.

In addition, it is thought that heat generated by friction of the mechanical polishing particles 31 may promote the chemical polishing effect.

In this polishing process, the mechanical polishing particles 31 are captured by the foaming resin 32 since they are contained in the foaming resin 32. For this reason, the mechanical polishing particles 31 cannot slip between the polishing surface of the polishing cloth 3 and the polished surface of the object or it cannot be impossible to obtain a predetermined friction force thereby. The mechanical polishing particles 31 polish the polished surface of the object with a great friction force in accordance with the rotation of the polishing cloth 3.

Figure 6:
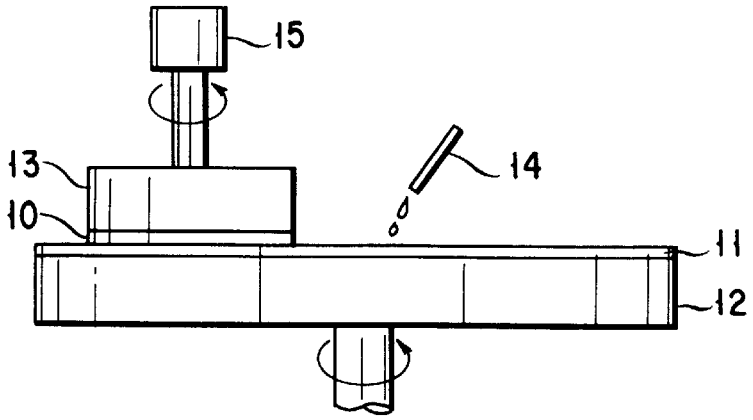
FIG. 6 PRIOR ART
FIG. 6 is a cross-sectional view showing a conventional polishing apparatus.

The polishing rate of the wafer 10 will be compared with that in the polishing process executed by use of a conventional polishing apparatus shown in FIG. 6. In the polishing apparatus of this embodiment, the lowering degree of the polishing rate obtained when one wafer is polished is smaller than that in the prior art. This reason can be understood as follows. As mentioned above, it is thought that the polishing process based on the friction of the mechanical polishing particles 31 may proceed according to the mechanical polishing particles 31 captured in the foaming resin 32 and that the shavings of the wafer 10 generated by the polishing may lower the capturing force of the mechanical polishing particles 31, which may cause the polishing rate to be lowered.

Figure 4A:
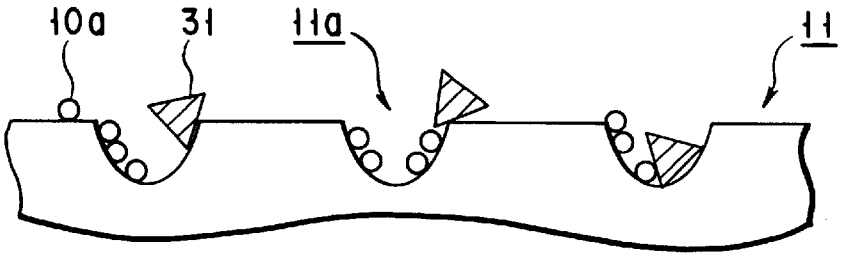
FIG. 4A PRIOR ART

In the conventional polishing cloth 11 formed of foaming resin, since there is originally nothing in the recess portions 11*a* of the polishing surface, the mechanical polishing particles 31 in the polishing liquid and shavings 10*a* enter the recess portions 11*a* in the polishing process as shown in FIG. 4A. That is, the mechanical polishing particles 31 enter the recess portions 11*a* prior to the shavings, or the shavings enter prior to the mechanical polishing particles 31, or both enter together. For this reason, it is thought that the mechanical polishing particles 31 in a stable state may hardly enter the recess portions 11*a* and thereby the capturing force of the mechanical polishing particles 31 may be relatively lowered.

Therefore, if the polishing process proceeds and the amount of the shavings is increased, the shavings 10*a* can easily enter the recess portions 11*a* so as to reach bottoms of the recess portions 11*a*, the capturing force of the mechanical polishing particles 31 is further lowered, and the mechanical polishing particles 31 are driven out of the recess portions 11*a*. As understood from the above description, in the conventional polishing cloth 11, the rate in reduction of the mechanical polishing particles 31 captured in the recess portions 11*a* becomes higher as the polishing process proceeds, and therefore, it is gathered that the polishing force obtained from the mechanical polishing particles 31 may be remarkably reduced.

Figure 4B:
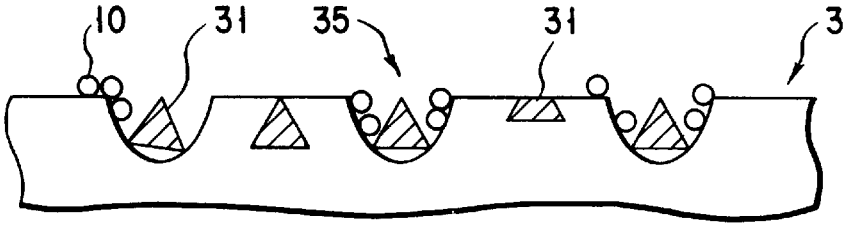

On the other hand, in the polishing cloth 3 of the present embodiment, the mechanical polishing particles 31 are contained in the foaming resin 32 so as to be captured therein. On the polishing surface of the polishing cloth 3, the mechanical polishing particles 31 are captured in a stable state, i.e. by a large capturing force in the recess portions 35 from the beginning of the polishing process as shown in FIG. 4B. Thus, parts of the particles located near the polished surface are exposed from the polished surface and the other parts are embedded in the cloth 3. In addition, since the mechanical polishing particles 31 are present at the resin foaming stage, the recess portions 35 are formed in a shape which is comparatively applicable to the mechanical polishing particles 31.

Therefore, even if the polishing process proceeds and the shavings are generated, the shavings hardly drive the mechanical polishing particles 31 out of the recess portions 35, since originally the shavings cannot easily enter the recess portions 35, and since the shavings can hardly reach the bottom of the recess portions 35 even if they enter the recess portions 35.

Further, the recess portions 35 are not formed around the mechanical polishing particles 31 that enter the areas other than the spaces 33, the mechanical polishing particles 31 are always present on the polishing surface. Thus, even if the polishing process proceeds with this polishing cloth 3, the polishing force of the mechanical polishing particles 31 can be kept for a long time since the rate of reduction in the number of the mechanical polishing particles 31 captured in the recess portions 55 is small.

As understood from the above description, since the polishing rate is lowered at a small degree when one wafer 10 is polished with the polishing cloth 3 of the present embodiment, the polishing cloth 3 does not need to be frequently polished by use of diamond, etc. to recover its polishing force, and for example, it may be polished after 25 wafers 10 have been polished. Therefore, since the total number of the polishing using diamond, etc. is reduced at the polishing process, the amount of the shavings of the foaming resin 32 generated by the polishing process is restricted to some extent and the life of the foaming resin 32 is thereby made longer.

As a result, the exchange of the polishing cloth 3 may be executed after, for example, 12,500(=25×500) wafers 10 have been processed. Since the number of the exchange of the polishing cloth 3 is reduced at the polishing process, the throughput of the polishing process can be enhanced. That is, according to the present embodiment, a polishing apparatus, a polishing member and a polishing method which aim at making the life of the polishing layer or the polishing cloth longer and thereby enhance the throughput of the polishing process are provided.

In addition, in the above-described embodiment, since the mechanical polishing particles 31 may not be contained in the polishing liquid, the polishing liquid can be easily adjusted. Further, since the polishing process is executed while supplying the polishing liquid containing the chemical polishing particles so as to supply the chemical polishing particles in a liquid state, the chemical polishing particles are dispersed uniformly on the polishing surface, and the polished surface of the wafer 10 can be uniformly processed. In the present embodiment, however, after impregnating the chemical polishing particles in advance in the foaming resin 32 of the polishing cloth 3, the polishing liquid containing the chemical polishing agent may or may not be supplied from the nozzle. In addition, after containing the mechanical polishing particles in the polishing liquid supplied from the nozzle, they may be used together with the mechanical polishing particles contained in the polishing cloth.

Figure 5:
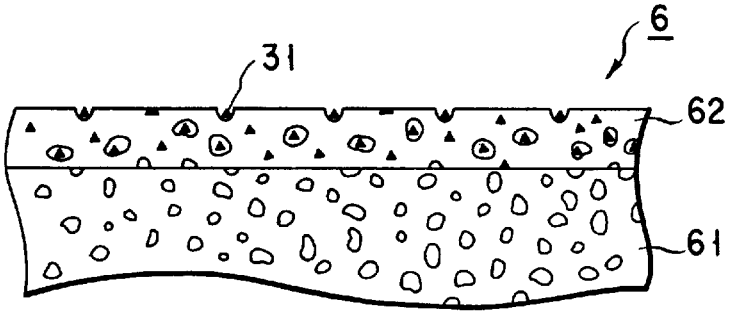
FIG. 5 is a cross-sectional view showing another example of the polishing cloth used in the polishing apparatus of the present invention.

Further, in the present invention, the surface of the polishing cloth 3 facing, at least, the polishing surface may be formed of the foaming resin 32 containing the mechanical polishing particles 31. Therefore, as shown in FIG. 5, a layer of second foaming resin 62 that contains the mechanical polishing particles 31 and serves as a polishing layer may be overlapped on a layer of first foaming resin 61 that does not contain the mechanical polishing particles 31 and then the polishing cloth 6 may be formed by employing the surface of the second foaming resin 62 as the polishing surface.

Such the polishing cloth 6 is formed by a method of applying by means of spin coating the liquid obtained by dispersing the mechanical polishing particles 31 in the binder resin onto, for example, the surface of the first foaming resin 62 or attaching a thin layer of the second foaming resin 62 containing the mechanical polishing particles 31 in advance to the surface of the first foaming resin 61. Since the polishing rate is lowered at a small degree even in this polishing cloth 6, the life of the polishing cloth 6 becomes longer, and as a result, the throughput of the polishing process can be enhanced.

In the present invention, the foaming resin other than the foam urethane resin can be used to form the polishing layer, and a material which does not have a smooth polishing surface, i.e. which has bumps with a certain elastic force, for example, nonwoven fabric cloth, etc. can be preferably used, other than the foaming resin, for the polishing layer. However, the polishing layer of the present invention is not limited to this elastic object and can be formed of a material such as hard synthetic resin, which does not have the elastic force.

Moreover, the object is not limited to a semiconductor wafer and may be, for example, a liquid-crystal panel display board, etc.

In the polishing apparatus of the above-described embodiment, an object to be polished is polished by use of one single wafer holding member (an object holding member). However, a plurality of objects may be simultaneously polished by arranging a plurality of holding members at a common horizontal level so as to face the polishing layer. The embodiment of the polishing apparatus has been explained above as an example thereof, but the other type of the polishing apparatus may be employed, for example, the polishing cloth may be attached to an endless belt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

What is claimed is:

1. A polishing apparatus comprising:

a polishing layer having a polishing surface in which a plurality of recess portions are formed, and a plurality of mechanical polishing particles contained in the polishing layer so as to be partially exposed from the polishing surface and received in the recess portions, the mechanical polishing particles captured by the polishing surface; and a drive mechanism for moving an object to be polished and the polishing layer in which the mechanical polishing particles are contained relative to each other to contact with each other and polish the object with the mechanical polishing particles, in a state in which the object is allowed to contact with the polishing surface of the polishing layer.

2. A polishing apparatus according to claim 1, further comprising means for supplying a polishing liquid containing a chemical polishing agent, wherein said liquid does not contain mechanical polishing particles.

3. A polishing apparatus according to claim 1, further comprising means for supplying a polishing liquid containing mechanical polishing particles and a chemical polishing agent.

4. A polishing apparatus according to claim 1, wherein said drive mechanism comprises:

a holding member for holding the object to be polished;

a rotary table being provided with said polishing layer and having an axis;

a first drive source for rotating said rotary table about the axis serving as a center of rotation and allowing the polishing layer to rotate;

a second drive source for rotating said holding member and allowing the object to rotate; and means for disposing the holding member so as to allow the object to contact with the polishing surface of the polishing member at a position displaced from the axis of the rotary table, wherein said polishing apparatus further comprises a polishing liquid supplying means having a nozzle to supply the polishing liquid to part of the polishing surface which is located at the axis of the rotary table.

5. A polishing apparatus according to claim 1, wherein said polishing layer is formed of foaming resin.

6. A polishing apparatus according to claim 5, wherein said foaming resin has foam spaces having an average diameter of approximately 200 to 500 nm.

7. A polishing apparatus according to claim 6, wherein said mechanical polishing particles comprise silica-based polishing particles having an average diameter of 30 to 100 nm.

8. A polishing apparatus according to claim 6, wherein said mechanical polishing particles comprise alumina-based polishing particles having an average diameter of 50 to 300 nm.

9. A polishing apparatus according to claim 6, wherein said mechanical polishing particles comprise ceria-based polishing particles having an average diameter of 50 to 300 nm.

10. A polishing apparatus according to claim 5, wherein a foaming density of said foaming resin ranges from 15 to 30%.

11. A polishing apparatus according to claim 1, wherein said polishing layer includes a foaming resin layer and a plurality of further mechanical polishing particles dispersed in the foaming resin layer.

12. A polishing apparatus according to claim 11, wherein said foaming resin layer is made by dispersing the mechanical polishing particles in a binder resin and forming the binder resin.

13. A polishing apparatus comprising:

a foaming resin polishing layer having a plurality of foam spaces formed therein and a polishing surface to define a plurality of recess portions, and a plurality of mechanical polishing particles contained in the polishing layer, some of the mechanical polishing particles being positioned in the foam spaces, and on the polishing surface so as to be partially exposed from the polishing surface and fixed thereon; and a drive mechanism for moving an object to be polished and the polishing layer in which the mechanical polishing particles are contained relative to each other to contact with each other and polish the object with the mechanical polishing particles, in a state in which the object is allowed to contact with the polishing surface of the polishing layer.

* * * * *